United States Patent [19]

Ingham

[11] 3,952,682

[45] Apr. 27, 1976

[54] STEERING ASSEMBLY FOR A MARINE CRAFT

[75] Inventor: Michael J. Ingham, Epsom, England

[73] Assignee: Richard Marine Limited, Twickenham, England

[22] Filed: Dec. 2, 1974

[21] Appl. No.: 528,628

[30] Foreign Application Priority Data

Dec. 4, 1973 United Kingdom ..... 56244/73

[52] U.S. Cl. ..... 114/162; 114/165

[51] Int. Cl.[2] ..... B63H 25/06

[58] Field of Search..... 114/128, 130, 132, 144 R, 114/162, 164, 165, 167

[56] References Cited

UNITED STATES PATENTS

| | | | |
|---|---|---|---|
| 3,269,347 | 8/1966 | Koenig | 114/162 |
| 3,352,272 | 11/1967 | Brazier | 114/165 |
| 3,575,124 | 4/1971 | Alter | 114/165 |
| 3,728,983 | 4/1973 | Ingham | 114/165 |
| 3,731,645 | 5/1973 | Pearce | 114/162 |

*Primary Examiner*—George E. A. Halvosa
*Assistant Examiner*—Stuart M. Goldstein
*Attorney, Agent, or Firm*—Baldwin, Wight & Brown

[57] ABSTRACT

A marine craft steering assembly comprises a rudder stock mountable on a craft for steering movements, and a rudder blade mounted on the stock to partake of steering movements therewith and to swing relatively to the stock to a raised position if the blade encounters an obstruction. The stock has an internal space extending fore-and-aft with an opening through one edge, as for example, the aft edge, and an inner wall facing the opening and being curved throughout at least a part of its extent. A pivot boss on the stock traverses the stock internal space, and the rudder blade has a curved internal surface pivotally mounted on the boss. The blade curved internal surface has a gap which may be passed over the boss to enable the blade internal curved surface to be positioned on the boss when the blade is inserted through the opening in the stock edge into the stock internal space.

19 Claims, 4 Drawing Figures

7
31
6
II
II
3
37
39
38
33
12
28
21
26
16
15
34
10
17
25
8
13
36
4
22
24
9
5
III
III
35
19
27
23
11
14
8
IV
IV
34
1
30
32
40
II
2
20

STEERING ASSEMBLY FOR A MARINE CRAFT

This invention relates to a steering assembly for a marine craft such as a sailing dinghy and is intended to provide a construction which will be cheap and easy to manufacture and simple to assemble. Moreover, it provides as assembly which can be used on numerous class boats and the rudder blade shape can be made to comply with class regulations.

Steering assemblies of the kind in which the rudder blade can be raised and lowered are sometimes referred to as a "lifting rudder" and in some classes such lifting rudders are not allowed. The present invention can however still be applied if suitable means are provided, such as a pin to hold the rudder rigidly in the lowered position whilst racing.

According to the present invention a steering assembly for a sailing craft comprises a rudder blade which is carried in a rudder stock and in relation to which it can pivot between raised and lowered positions, the rudder stock having a curved passage which extends around a pivot boss the diameter of which is greater than its axial length, and the upper part of the blade being in the form of a curved arm having a free end, at least part of the inner surface of the arm being part-circular and extending around the pivot boss.

With this kind of construction the normal kind of pivot pin which is usually employed to pivot the rudder blade is avoided and the larger radius of the pivot boss has certain advantages which will be discussed hereinafter. The construction also enables the rudder stock to be made more rigidly than hitherto because the pivot boss enables a large area of the cheeks of the rudder stock to be connected to each other whereas previously when only a pivot pin was employed the cheeks were only connected over a relatively small area by the pin.

The rudder blade could be moulded from, for example, a plastics material such as foamed polystyrene. The rudder stock could be made up from, for example, plastics material by fastening the parts together with adhesive again enabling the large diameter pivot boss to fasten relatively large areas of the cheeks of the rudder stock together.

In a preferred construction the part-circular inner surface of the arm extends around an angle of more than 180° and the boss is in part circular with a flat or flats to provide a dimension across the boss which is slightly less than the width of the gap between the free end of the blade arm and the other end of the circular part of the inner surface of the arm so that the blade can only be located on the boss by moving it transversely when it is in a position so that the flats are lined up with the gap, and the blade cannot be removed from the rudder stock in any other position.

The boss may thus be arranged to have a pair of diametrically opposed flats a distance between which across the diameter of the boss is slightly less than the width of said gap. With this arrangement the inner surface of the arm at the free end can be arranged to have a straight portion the length of which and the dimensions of the flats being so related that when the blade is assembled by moving the gap transversely across the boss, the axis of the curved inner surface of the arm cannot be aligned with the axis of the boss until the end of the curved inner surface of the arm remote from the free end of the arm is moved into an opening in one of the flats. This thus enables the blade to move into alignment with the axis of the boss and clears the straight end of the arm around the end of the flat on the boss which is preventing its rotation.

Preferably the gap is arranged to be aft of the boss when the rudder blade is in the lowered position and the flat or flats extend in a horizontal direction. With this arrangement it is therefore necessary to insert the arm into the curved passage from aft and with the arm lower than the boss, that is with the rudder blade in the position in which it extends upwardly away from the rudder stock. This position will never be achieved when the craft is in the water and the rudder blade will not therefore become detached due to its floating up whilst in the water.

In a convenient construction the walls of the curved passage are formed by the pivot boss, opposed side cheeks of the rudder stock and a fourth wall opposed to the pivot boss and at least part of which is concentric with the curved surface of the boss.

This fourth wall may have a lower portion which is straight and which provides an abutment to define the position of the rudder blade when lowered.

In one preferred embodiment the rudder stock carries a tiller which is arranged to interact with the arm so that the rudder blade can be raised and lowered by longitudinal movement of the tiller in the rudder stock. A steering assembly for a sailing craft employing this feature is the subject of the Applicant's co-pending application Ser. No. 528,665, filed Dec. 2, 1974.

With this arrangement an abutment can be provided on the free end of the arm which engages the end of the steering tiller and the tiller is preferably carried in a bore in the upper part of a rudder stock.

Preferably the rudder stock is pivoted to the hull of the craft with which it is to be used by releasable means which are locked in position by the steering tiller. Thus, rudder stock may be provided with two relatively vertically displaced extensions which are releasably located on relatively vertically displaced pivot members on the hull, the steering tiller extending along at least part of the upper extension.

With this arrangement the extensions can be provided with axially aligned circular openings which are located on the upper and lower pivot members which are respectively upwardly and downwardly projecting bosses, the tiller acting to locate the upper opening on the upper boss and to prevent the lower opening dropping below the lower boss.

In a convenient construction the upper and lower bosses are provided with means for attachment to the hull of the boat and they can be connected by a bar or tube.

The rudder stock is particularly suitable for manufacture from a plastics material.

The invention also includes a rudder stock for use with a steering assembly as set forth and having a curved passage which extends around a pivot boss the diameter of which is greater than its axial length.

The invention may be performed in many ways but one embodiment will now be described by way of example and with reference to the accompanying drawings in which.

Figure 1:
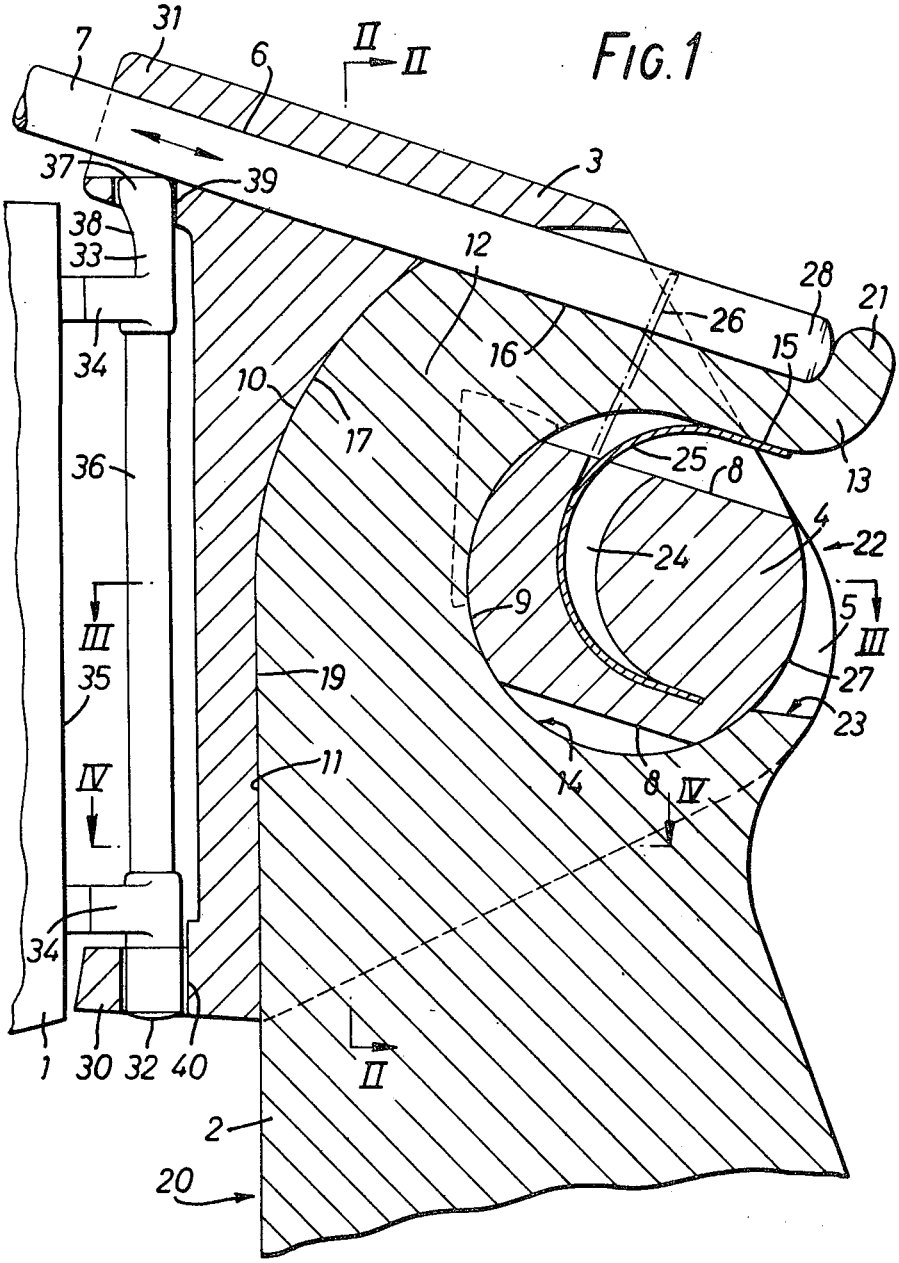
FIG. 1 is a fragmentary vertical longitudinal sectional view of a marine craft steering assembly according to the invention.
Figure 2:
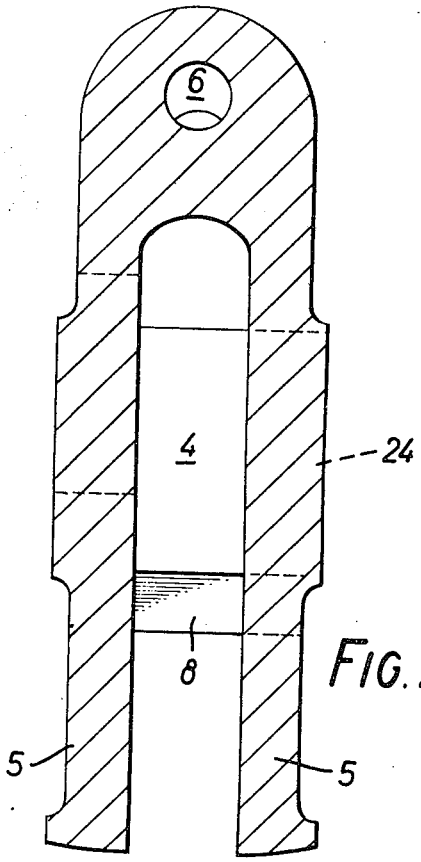
FIG. 2 is a vertical cross sectional view of the rudder stock shown in FIG. 1 on the line II—II, the rudder stock being shown in FIG. 2 in complete cross section including the half section thereof which is not shown in FIG. 1 but which is opposite to and companion with the half section which is shown in FIG. 1, a rudder blade shown in FIG. 1 being omitted from FIG. 2.
Figure 3:
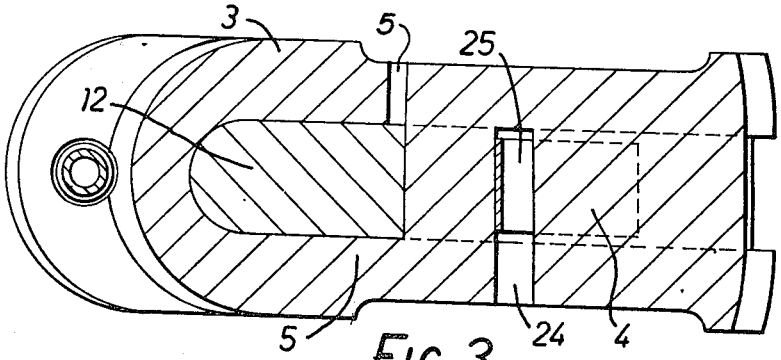
FIG. 3 is a horizontal cross-sectional view taken on the line III—III in FIG. 1.
Figure 4:
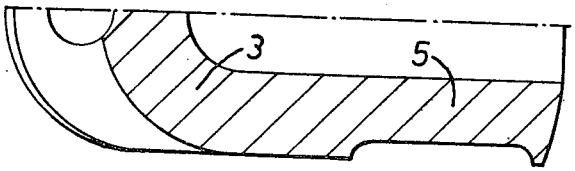
FIG. 4 is a horizontal cross sectional view taken on the line IV—IV of FIG. 1 but with the rudder blade removed, this view showing the half section of the rudder stock opposite to and companion with the half section of the rudder stock shown in FIG. 1.

As shown in the drawings a steering assembly is for a sailing dinghy the hull of which is indicated by reference numeral 1. The steering assembly comprises a rudder blade 2 which is pivoted to a rudder sotck 3 by means of a pivot boss 4. The pivot boss 4 extends between spaced cheeks 5 of the rudder stock 3 so that the blade 4 can be rotated in relation to the stock between raised and lowered positions. The upper end of the rudder stock 3 is formed with a bore 6 which accepts a tubular steering tiller 7.

The pivot boss 4 is moulded integral with the rudder stock and is circular having a diameter greater than its axial length and with a pair of diametrically opposed flats 8, the distance between the flats being less than the diameter of the circular portion. This boss thus provides a curved passage or channel in the rudder stock, two opposed side walls of the passage being provided by the cheeks 5 of the stock, one of the other walls being formed by a curved surface 9 and flats 8 of the boss and the other wall by a curved surface 10 and a substantially straight surface 11 in the stock. It will be seen from FIG. 1 that this curved passage extends around the pivot boss 4 and that the upper portion of the rudder blade 2 is in the form of a curved arm 12 which has a free end 13. Part of the inner surface 14 of the arm is circular and extends around the pivot boss 4 through an angle of approximately 200°. This part-circular portion terminates in an upper straight surface 15 which is tangential to the curved surface 14 and beneath the end 13 of the arm. The outer surface of the arm 12 has a flat upper portion 16 which is substantially parallel with the straight portion 15 and which terminates at one end in a curved surface 17 which is concentric with the surface 9 of the boss 4. This curved surface 17 leads to a substantially straight surface 19 which runs into the leading edge 20 of the rudder blade 2. The outer end of the surface 16 runs into an abutment 21 provided on the free end of the arm 13.

The gap indicated by reference numeral 22 between the end of the lower surface 15 and the free end 13 of the arm 12 considered together, and the end of the curved inner surface 14 terminating at a straight surface 23 which delineates the bottom of the gap is only slightly larger than the distance between the flats 8 and it will be seen that this gap is aft of the boss 4 when the rudder blade 2 is in its lowered position as shown in the drawings. A curved tapered slot 24 opens through one cheek 5 the boss 4 and extends from the upper flat 8 of the boss and located in this slot is a leaf spring 25 made from a suitable plastics material or a metal such as stainless steel. One end of the spring nests in the lower end of the slot 24 and the upper end projects into the curved channel. The free position of the spring is shown in broken lines 26 in FIG. 1.

Before the blade 2 is mounted in the stock, the spring 25 is inserted in the boss slot 24 with one end of the spring nesting in the lower end of the slot and the other end of the spring extending as shown in broken lines at 26.

The rudder blade is then mounted in the rudder stock 3 by sliding it transversely over the boss 4 and between the cheeks 5 from aft with the rudder blade extending upwardly, that is rotated from the position shown in FIG. 1 counterclockwise in the general plane of the blade. In this position the free end 13 of the arm 12 is slid between the rudder cheeks until the curved surface of the arm 14 engages the rear surface 27 of the boss 4. The straight surface 23 at the end of the curved surface 14 is now dropped into the slot 24 in the boss which aligns the axis of the curved surface 14 of the inner wall with the axis of the boss and enables the straight surface 15 of the arm 12 to pass beyond the end of the lower flat 8 so that the blade can be rotated in a clockwise direction as shown in FIG. 1 about the boss 4 until the free end 13 of the arm 12 engages the spring 26 and bends it to its biasing or loaded position as shown in full lines in FIG. 1. Provided the assembly is not inverted it can be carried in this position without the rudder blade or rudder stock detaching themselves from each other.

When the rudder stock is located on the boat in a manner hereinafter to be described, the tiller 7 is inserted rearwardly into the bore 6 until its end 28 engages the abutment 21 on the free end 13 of the arm 12. Further rearward movement of the tiller now causes the rudder blade to rotate clockwise around the boss 4 at the same time causing the spring 25 to bend until the fully lowered position of the blade 2 is reached as shown in FIG. 1. The friction between the tiller 7 and the walls of the bore 6 is sufficient to hold the tiller in this position against the action of the spring 25 which is now loaded thus biasing the rudder blade counterclockwise towards the raised position. Because the abutment 21 tends to lift the end 28 of the tiller as the abutment rotates forward pressure to raise the blade thus increases the friction between the tiller and the wall of the bore 6. Should the leading edge 20 of the rudder strike an obstruction which is sufficient to overcome the friction between the tiller and the bore 6 the spring 25 will assist in lifting the rudder. Again, if the tiller is deliberately moved to the left as shown in FIG. 1 to permit the rudder blade to raise the spring will assist the water action in raising the rudder blade. When the assembly is removed from the boat with which it has been used the rudder blade will not immediately drop again because the spring will hold it in the position in which it extends substantially horizontally.

The rudder stock 3 is provided with two vertically displaced extensions 30, 31 which are releasably located on vertically displaced pivot members in the form of downwardly and upwardly directed bosses 32, 33 respectively. Each boss is moulded from a plastics material and has location lug 34 by means of which it can be attached to the transom 35 of the boat hull 1. The bosses 32, 33 are joined by a bar or tube 36 of a suitable material such as aluminum or plastics material. The upper boss 33 has an enlarged head 37 which is formed by cutting back the boss below it at 38. The extension 31 is provided with a circular opening 39 and the lower extension 30 with an opening 40. The opening 39 extends upwardly into the bore 6. When it is desired to locate the rudder stock on the boat the opening 39 is placed over, that is above, the upper boss 33 with the stock tilted so that the lower extension 30 is displaced out of line with the lower boss 32. The rudder stock is then lowered until it is possible to tilt it slightly to allow the opening 40 to be aligned with the lower boss 32. The slight tilting is possible due to the cut-back 38 in the upper boss 33. The rudder stock is now raised so that the lower opening 40 is located on the lower boss 32 and the enlarged head 37 is located in the opening 39. The tiller 7 is now inserted into the bore 6 and rests on top of the enlarged head 37 which prevents the rudder head from dropping and maintains the rudder head on the bosses. When it is desired to remove the rudder stock it is merely necessary to completely withdraw the tiller 7 until it is clear of the upper boss 38 and the process is reversed.

Although biasing means in the form of a spring 25 are described in this embodiment such a spring could be omitted and the buoyancy of the rudder blade itself relied upon to lift the rudder blade whilst sailing or the tiller could be connected by a line or other means to the abutment 21 to pull the tiller up when required. If it was intended to pin the rudder down during racing the spring could again be omitted.

Again, the helmsman may prefer to hold the rudder down by a line or lines running, for example, along the tiller and the invention is not limited to embodiments in which the tiller acts to hold the rudder blade in its various positions. In an alternative embodiment, not shown, the tiller is carried in a blind bore or is provided with means for rigidly locating it on the rudder stock and the arm is not connected to it. The blade is raised and lowered merely by moving the blade itself and any convenient means can be used to do this such as by manually gripping the blade or by means of lines on the tiller. If desired the blade could be located in various positions by passing a pin through a series of holes in the blade or rudder stock. Location means of this kind are well known in themselves in dinghys but the use of a rudder stock and rudder blade arm as set forth in the invention have great advantages as they enable an extremely light rudder stock to be employed utilising, for example, foamed polystyrene and the whole assembly is simple to assemble.

What we claim is:

1. A marine craft steering assembly comprising a rudder stock having an aft edge and a forward edge adapted to be mounted on a craft for substantially horizontal steering movements, said stock having an internal space extending fore-and-aft with an opening through one of said edges of said stock and an inner wall which is spaced inwardly from the other edge of said stock, said inner wall being curved throughout at least a part of its extent with said curved part facing said opening and extending vertically with respect to and above said space; a pivot boss on said stock traversing said space horizontally; and a rudder blade having an internally curved surface pivotally mounting said blade on said boss, the walls of said internal space and said pivot boss defining a curved passage within said stock into which a part of said blade is insertable through said opening for mounting said blade pivotally on said boss.

2. A marine craft steering assembly according to claim 1 in which said boss has a diameter greater than its axial length horizontally in said space.

3. A marine craft steering assembly according to claim 1 in which said opening is at the aft edge of said stock.

4. A marine craft steering assembly according to claim 1 in which said blade internally curved surface terminates in a gap, whereby said blade may be inserted into said passage by movement of said blade through said opening and movement of said gap over said boss to bring said internally curved surface into engagement with said boss, whereby to mount said blade pivotally on said boss.

5. A marine craft steering assembly according to claim 4 in which said opening is at the aft edge of said stock.

6. A marine craft steering assembly according to claim 4 in which said boss has a flat, said internally curved surface extends throughout more than 180°, and said gap is wider than the diametric width of said boss normal to said flat.

7. A marine craft steering assembly according to claim 6 in which said boss has a pair of diametrically opposed flats, said gap being wider than the diametric distance between said flats.

8. A marine craft steering assembly according to claim 6 in which said opening is at the aft edge of said stock.

9. A marine craft steering assembly according to claim 6 in which said boss flat is provided with a slot which receives one end of said internally curved surface upon insertion of said blade into said passage, whereby to align said internally curved surface with the axis of said boss.

10. A marine craft steering assembly according to claim 5 in which said blade includes a curved arm having a free end extending aft within said passage.

11. A marine craft steering assembly according to claim 10 in which said arm free end has a straight bottom surface extending above said boss and being tangent to said internally curved surface at one terminal end thereof.

12. A marine craft steering assembly according to claim 8 in which said blade includes a curved arm having a free end extending aft within said passage, said arm free end having a straight bottom surface extending above said flat and being tangent to said internally curved surface at one terminal end thereof.

13. A marine craft steering assembly according to claim 3 in which said stock inner wall comprises a lower portion extending vertically below and forwardly of said boss and providing an abutment engageable by said blade when the latter is swung about said boss to a lowered position.

14. A marine craft steering assembly according to claim 7 in which said stock inner wall comprises a lower portion extending from an upper curved portion thereof vertically below said boss and providing an abutment engageable by said blade when the latter is swung about said boss to a lowered position.

15. A marine craft steering assembly according to claim 13 in which said stock inner wall lower portion is substantially straight and said blade has a substantially straight forward edge portion extending downwardly and being engageable with said abutment for limiting pivotal movement of said blade with respect to said stock.

16. A marine craft steering assembly according to claim 5 in which said blade, when mounted pivotally on said boss, is swingable from a lowered normal steering position to a raised position for clearing an obstruction, and in which said gap is aft of said boss when said blade is in said lowered position.

17. A marine craft steering assembly according to claim 3 including first pivot means adapted to be attached to a craft hull; companion pivot means on said stock releasably pivotally connected to said first pivot means; and a tiller detachably connected to said stock and when connected thereto locking said companion pivot means against being released from said first pivot means.

18. A marine craft steering assembly according to claim 17 in which said first pivot means comprises an upwardly extending pivot member and therebelow a downwardly extending pivot member, and in which said companion pivot means comprises an opening in the upper part of said stock engageable with said upwardly extending pivot member, and an opening in the lower part of said stock engageable with said downwardly extending pivot member.

19. A marine craft steering assembly according to claim 18 in which said stock is formed with a substantially horizontal bore which extends above said opening in the upper part of said stock, and in which said tiller is slidable in said bore from a position displaced from being over said opening in the upper part of said stock to a position over said opening in the upper part of said stock in which latter position said tiller locks said companion pivot means against being released from said first pivot means.

* * * * *

UNITED STATES PATENT OFFICE

CERTIFICATE OF CORRECTION

Patent No. 3,952,682 Dated April 27, 1976

Inventor(s) Michael J. Ingham

It is certified that error appears in the above-identified patent and that said Letters Patent are hereby corrected as shown below:

In the patent heading, correct the Assignee, presently reading "Richard Marine Limited" to read --Richmond Marine Limited--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*